US010145277B2

(12) United States Patent
Newman et al.

(10) Patent No.: US 10,145,277 B2
(45) Date of Patent: Dec. 4, 2018

(54) CRANKCASE VENTILATION FOR TURBOCHARGED ENGINE

(71) Applicant: FORD GLOBAL TECHNOLOGIES, LLC, Dearborn, MI (US)

(72) Inventors: Christopher W. Newman, Farmington Hills, MI (US); Roy A. Ford, Monroe, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 125 days.

(21) Appl. No.: 15/645,422

(22) Filed: Jul. 10, 2017

(65) Prior Publication Data

US 2017/0306814 A1 Oct. 26, 2017

Related U.S. Application Data

(63) Continuation of application No. 14/525,554, filed on Oct. 28, 2014, now Pat. No. 9,771,841.

(51) Int. Cl.
*F01M 13/00* (2006.01)
*F02B 25/06* (2006.01)
(Continued)

(52) U.S. Cl.
CPC ..... *F01M 13/02* (2013.01); *F01M 13/00* (2013.01); *F01M 13/0011* (2013.01); *F01M 2013/027* (2013.01); *F02M 25/06* (2013.01)

(58) Field of Classification Search
CPC .. F01M 13/00; F01M 13/0011; F01M 11/064; F01M 13/001; F01M 2013/0022;
(Continued)

(56) References Cited

U.S. PATENT DOCUMENTS 2,685,867 A * 8/1954 Bergman ..... B25D 9/10 123/195 R
2,692,609 A * 10/1954 Carter ..... F16K 31/34 137/389

(Continued)

FOREIGN PATENT DOCUMENTS

CN 101608562 B 8/2011
DE 10249720 A1 5/2004

*Primary Examiner* — Lindsay Low
*Assistant Examiner* — Syed O Hasan
(74) *Attorney, Agent, or Firm* — Julia Voutyras; MacMillan, Sobanski & Todd, LLC

(57) ABSTRACT

An internal combustion engine for an automotive vehicle has an intake manifold receiving fresh air via an inlet duct. The engine includes a crankcase. A turbocharger is provided having a compressor with an inlet coupled to the inlet duct and an outlet coupled to the intake manifold. A first vent line couples the crankcase with the compressor inlet. A second vent line couples the crankcase with the compressor outlet and intake manifold. The second vent line has a valve blocking air flow into the crankcase and allowing air flow out from the crankcase. The first vent line comprises a dual-acting valve having a first flow capacity into the crankcase and a second flow capacity out from the crankcase which is greater than the first flow capacity. Thus, crankcase ventilation is optimized for both engine idle and high engine load conditions.

5 Claims, 3 Drawing Sheets

(51) Int. Cl.
*F01M 13/02* (2006.01)
*F02M 25/06* (2016.01)

(58) Field of Classification Search
CPC .. F01M 13/02; F01M 2013/027; F02M 25/06; F02D 2250/08; Y02T 10/121
USPC ..... 123/344, 572–574, 41.86, 396, 568.11
See application file for complete search history.

(56) References Cited

U.S. PATENT DOCUMENTS

| | | | | |
|---|---|---|---|---|
| 2,778,543 | A * | 1/1957 | Urlaub | B65D 83/32 222/402.11 |
| 7,775,198 | B2 | 8/2010 | Shieh | |
| 8,393,315 | B2 | 3/2013 | Ruppel et al. | |
| 8,695,339 | B2 * | 4/2014 | Spix | F01M 13/028 123/572 |
| 2004/0069399 | A1 | 4/2004 | Parker et al. | |
| 2012/0048248 | A1 * | 3/2012 | Valencia | F01M 13/0011 123/574 |
| 2013/0048117 | A1 * | 2/2013 | Opdenbosch | E02F 9/2217 137/565.01 |
| 2014/0081564 | A1 | 3/2014 | Pursifull et al. | |
| 2014/0116399 | A1 * | 5/2014 | Ulrey | F02M 25/08 123/520 |

* cited by examiner

CRANKCASE VENTILATION FOR TURBOCHARGED ENGINE

CROSS REFERENCE TO RELATED APPLICATIONS

This application is a continuation of co-pending U.S. application Ser. No. 14/525,554, filed Oct. 28, 2014, which is incorporated herein by reference.

STATEMENT REGARDING FEDERALLY SPONSORED RESEARCH

Not Applicable.

BACKGROUND OF THE INVENTION

The present invention relates in general to crankcase ventilation for internal combustion engines, and, more specifically, to a dual-acting valve for crankcase ventilation of a gasoline engine that employs a turbocharger for compressing the intake air at high engine loads.

Gases accumulate in an engine crankcase when gases from engine cylinders bypass engine pistons and enter the crankcase during engine rotation. These gases are commonly referred to as blowby gases. The blowby gases can be combusted within engine cylinders to reduce engine hydrocarbon emissions using a positive crankcase ventilation (PCV) system which returns the blowby gases to the engine air intake and combusting the gases with a fresh air-fuel mixture. Combusting crankcase gases via the engine cylinders may require a motive force to move the crankcase gases from the engine crankcase to the engine air intake. One conventional way to provide motive force to move crankcase gases into the engine cylinders is to provide a conduit between the crankcase and a low pressure region (e.g., vacuum) of the engine intake manifold downstream of an engine throttle body. In addition, fresh air from a point upstream of the throttle body is added to the crankcase via a separate conduit (i.e., breather) to help flush the blowby products from the crankcase and into the intake manifold.

Use of turbocharging with combustion engines is becoming increasingly prevalent. In an exhaust-gas turbocharger, for example, a compressor and a turbine are arranged on the same shaft (called a charger shaft) wherein a hot exhaust-gas flow supplied to the turbine expands within the turbine to release energy and cause the charger shaft to rotate. The charger shaft drives a compressor which is likewise arranged on the charger shaft. The compressor is connected in an air inlet duct between an air induction and filtering system and the engine intake manifold so that when the turbocharger is activated, the charge air supplied to the intake manifold and engine cylinders is compressed.

Turbocharging increases the power of the internal combustion engine because a greater air mass is supplied to each cylinder. The fuel mass and the mean effective pressure are increased, thus improving volumetric power output. Accordingly, the engine displacement used for any particular vehicle can be downsized in order to operate with increased efficiency and reduced fuel use, wherein the turbocharger is inactive during times of low power requirements and is activated during times of high load, such as wide open throttle (WOT). In addition to reduced fuel consumption, turbocharging has a beneficial effect of reducing emissions of carbon dioxide and pollutants.

Due to the increased pressure at the intake manifold during high load operation which results from compressing the inlet air by the turbocharger compressor, modifications to the conventional crankcase ventilation system are necessary. In particular, the high pressure introduced downstream of the compressor (e.g., in the intake manifold) could reverse the flow in the vent line thereby pressurizing the crankcase to an extent that could cause failure of the seals. To prevent such a reversal, a check valve is usually placed in that vent line. To avoid a buildup of blowby gas in the crankcase, the flow is allowed to reverse in the other vent line (i.e., the breather that otherwise supplies fresh air from a point upstream of the throttle body and turbocharger compressor into the crankcase). Thus, any pressure buildup in the crankcase that could damage the seals is prevented.

During engine idling when a large vacuum is present at the intake manifold, it is desirable to maintain a negative pressure in the crankcase so that blowby gases are readily captured and removed. To ensure a negative crankcase pressure at idle on a boosted gas (i.e., turbocharged) engine, it is often necessary to restrict the fresh air feed to the crankcase. An appropriately sized restriction in the corresponding breather vent line is used to accomplish this. However, if the crankcase fresh air feed is restricted too much then the crankcase may become positively pressurized under full load conditions (i.e., when the restricted vent line or breather reverses flow to evacuate the blowby gases into the low pressure section of the air inlet system), which can jeopardize the crankcase sealing integrity. It is often difficult or impossible to find a restriction level that provides the needed vacuum at idle while not creating an undesirably large positive pressure during full load operation.

SUMMARY OF THE INVENTION

The present invention solves the foregoing problem using an active valve with a dual flow rate orifice. A small orifice provides a smaller flow capacity at idle to ensure the necessary crankcase vacuum. Under full load, the device transitions to a larger orifice to allow a higher flow capacity to prevent crankcase pressurization. One embodiment of such a device uses a spring-steel metal flap valve with a small hole in the center. During idle when fresh air is flowing through the device into the crankcase, the metal flap is pulled shut against a larger orifice in a valve body in the form of a sealing wall (which can be part of an oil separator housing, for example). In this position, the flow into the crankcase is controlled by the small hole in the center of the metal flap. Under full load when the flow direction reverses and blowby is flowing out of the crankcase, the metal flap valve is pushed open exposing the larger orifice under the metal flap. The larger orifice allow sufficient flow to prevent pressurization of the crankcase under full load. The device could be incorporated anywhere in the PCV system, such as directly integrated into the oil separator in the cam cover. It could also be incorporated into one of the PCV hoses or quick connectors in the PCV system. Other embodiments may include elastomeric check valves with holes directly in the check valve or small holes or passages that bypass the check valve when in the closed position.

In one aspect of the invention, a vehicle comprises an internal combustion engine with an intake manifold receiving fresh air via an inlet duct. The engine includes a crankcase. A turbocharger is provided having a compressor with an inlet coupled to the inlet duct and an outlet coupled to the intake manifold. A first vent line couples the crankcase with the compressor inlet. A second vent line couples the crankcase with the compressor outlet and intake manifold. The second vent line has a valve blocking air flow into the crankcase and allowing air flow out from the crankcase. The first vent line comprises a dual-acting valve having a first flow capacity into the crankcase and a second flow capacity out from the crankcase which is greater than the first flow capacity.

DETAILED DESCRIPTION OF PREFERRED EMBODIMENTS

Figure 1:
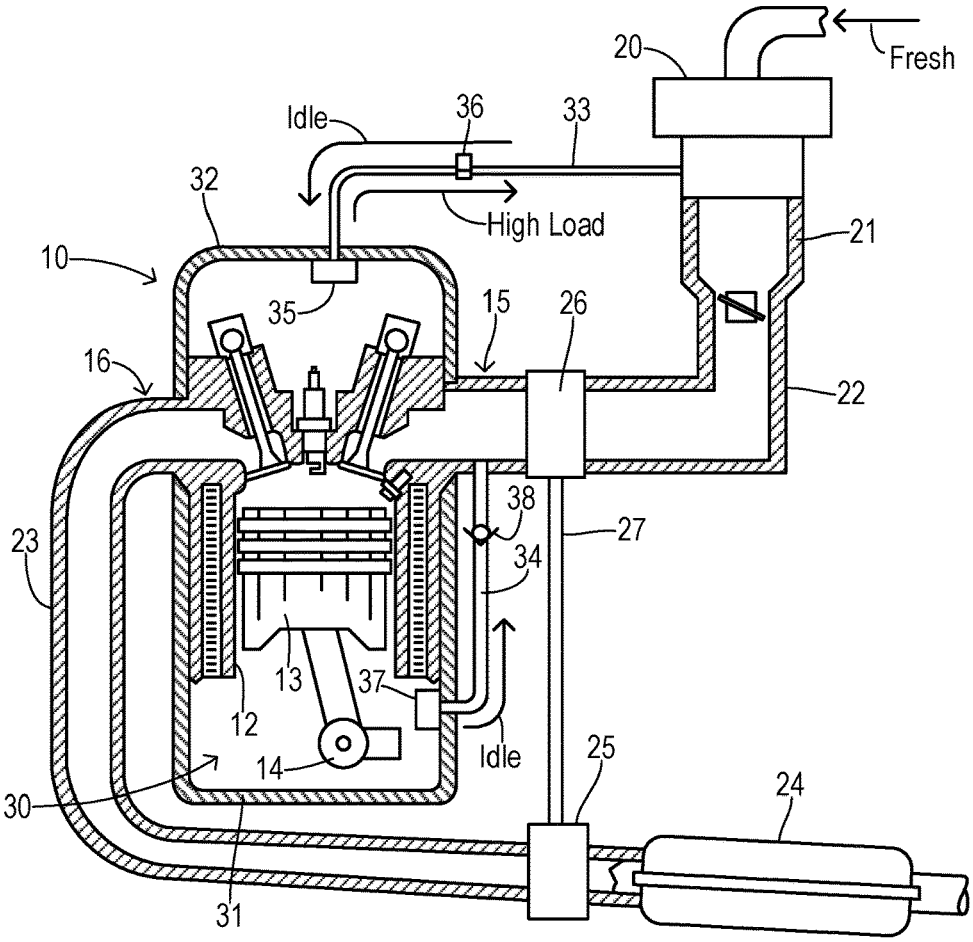
Fig. 1 (Prior Art)
FIG. 1 depicts a turbocharged internal combustion engine with a conventional crankcase ventilation arrangement.

Referring to FIG. 1, an internal combustion engine 10 in an automotive vehicle includes a plurality of cylinders. One cylinder is shown, which includes a combustion chamber 11 and cylinder walls 12 with piston 13 positioned therein and connected to crankshaft 14. Combustion chamber 11 communicates with an intake manifold 15 and exhaust manifold 16 via respective intake and exhaust valves operated by respective cams.

Engine 10 may preferably utilize direct fuel injection and an electronic distributorless ignition system as known in the art. Fresh outside air is conducted to engine 10 via an air filter 20, a throttle body 21, and an air inlet duct 22 connected to intake manifold 15. Combustion products exiting exhaust manifold 16 are conducted via a conduit 23 to a catalytic converter 24 on their way to an exhaust system (not shown). A turbocharging system is comprised of a turbine 25 positioned in the exhaust gas flow before catalytic converter 24 and coupled to a compressor 26 by a driveshaft 27. Exhaust gases passing through turbine 25 drive a rotor assembly which in turn rotates driveshaft 27. In turn, driveshaft 27 rotates an impeller included in compressor 26 thereby increasing the density of the air delivered to combustion chamber 11. In this way, the power output of the engine may be increased. One or more bypass valves (such as a wastegate) may be provided for turbine 25 and/or compressor 26 that are controlled in a desired manner to activate or deactivate turbocharging according to engine loading.

Crankcase 30 refers to a crankcase volume that may be defined in part by an oil pan 31 and a cam cover 32, for example. When an air-fuel mixture is combusted in engine combustion chamber 11, a small portion of combusted gas may enter crankcase 30 through the piston rings. This gas is referred to as blowby gas. To prevent this untreated gas from being directly vented into the atmosphere, a positive crankcase ventilation (PCV) system is utilized which includes a first vent line (breather) 33 and a second vent line 34. First vent line 33 is coupled between cam cover 32 and the low pressure side of compressor 26 such as at throttle body 21 (or alternatively at any other position along air inlet duct 22). Second vent line 34 is connected to crankcase 30 near oil pan 31 and to the high pressure side of compressor 26 (e.g., to intake manifold 15). Oil separators 35 and 37 are preferably included at the connections of vent lines 33 and 34 to crankcase 30 to remove entrained oil from any gasses being returned to the engine air intake.

During engine idling and low load conditions when turbocharger compressor 26 is not activated, a vacuum pressure in intake manifold 15 causes a crankcase ventilation flow in which fresh air enters crankcase 30 via first vent line 33 and leaves crankcase 30 via second vent line 34. A one-way check valve 38 in second vent line 34 allows flow in this direction. A restriction 36 in first vent line 36 has a size (i.e., flow capacity) that limits the amount of fresh air allowed to enter crankcase 30. When compressor 26 is activated during a high load condition such as wide-open throttle, pressure in intake manifold 15 increases to a pressure higher than the pressure in crankcase 30. Reverse flow in second vent line 34 is blocked by check valve 38. Excessive accumulation of blowby gas in crankcase 30 is avoided by allowing a reverse flow in first vent line 33. The sizing of restriction 36 has been a tradeoff between the desire to have a sufficiently small flow capacity during idle to maintain a desirable negative pressure in crankcase 30 (which would be lost if an unlimited amount of fresh air could enter via first vent line 33) and a desire to have a sufficiently large flow capacity during high engine load so that a high pressure buildup in crankcase 30 is avoided.

Figure 2:
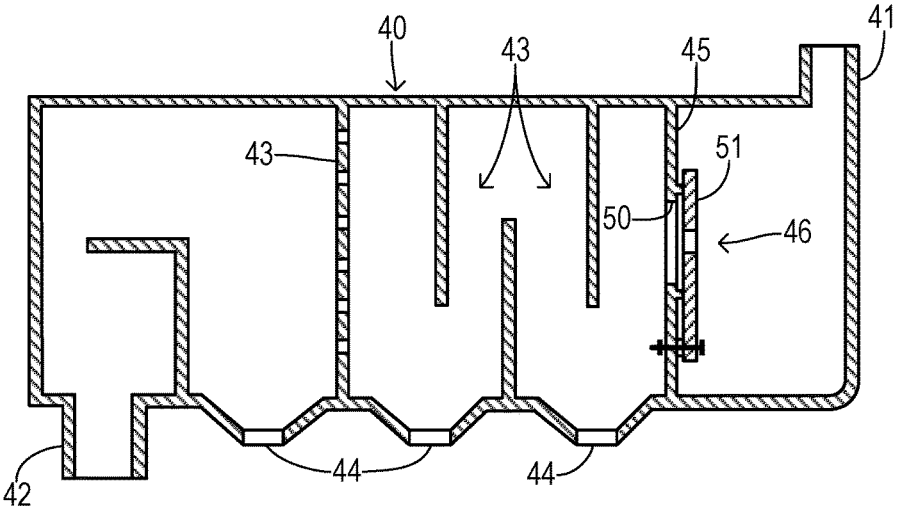
FIG. 2 is a cross-sectional view of an oil separator incorporating a dual-active valve of the present invention.
Figure 3:
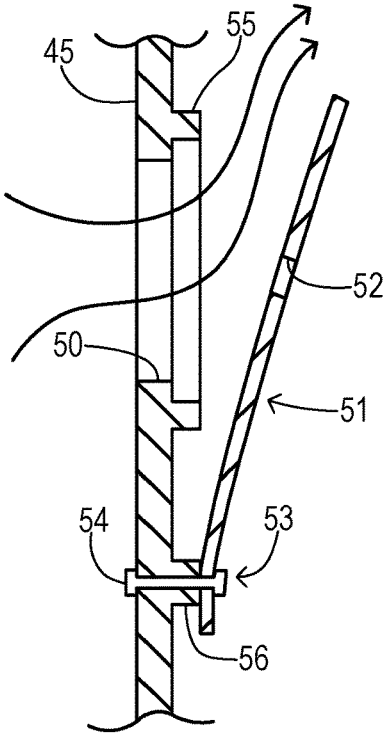
FIGS. 3 and 4 are cross-sectional views showing two positions of the valve of FIG. 2.
Figure 4:
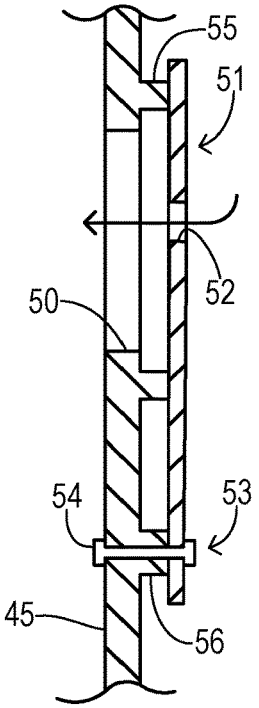

FIGS. 2-4 show a first embodiment of the invention for employing a dual-acting valve having a flow capacity which varies depending upon the direction of air flow in order to simultaneously obtain optimized performance for limiting the inflow of fresh air during engine idling and fully venting blowby gas during high engine load. An air oil separator 40, which may be integrated with a cam cover, includes an inlet 41, an outlet 42, and plurality of internal baffles 43 which collect oil and return it to the crankcase via drains 44. A sealing wall 45 partitions oil separator 40 into two separate chambers which are selectably coupled by dual-acting valve 46. Valve 46 includes a large opening 50 in sealing wall 45 which is configured to provide a large flow capacity during blowby flow from the crankcase. A movable flap 51 is arranged to cover opening 50 and has a smaller orifice 52 aligned with opening 50 configured to provide a smaller flow capacity for fresh air flowing in the direction into the crankcase. Movable flap 51 is coupled at a pivot point 53 to sealing wall 45 by a fastening pin 54. Movable flap 51 may preferably be comprised of a flat spring formed of sheet metal or other material that naturally returns to a flat configuration against opening 50 as shown in FIG. 4. To improve the seating of flap 51 on sealing wall 45, a raised sealing rib 55 is preferably disposed concentrically around opening 50 to bear against flap 51 when in the closed position. A boss 56 is preferably provided at pivot point 53 to align flap 51 with the outer edge of rib 55. As shown in FIG. 3, when the flow direction reverses through valve 46 in order to vent the crankcase during turbocharger activation, the flowing gas deflects flap 51 away from sealing wall 45 so that opening 50 is unblocked, thereby obtaining the higher flow capacity desired for venting the blowby gases.

Figure 5:
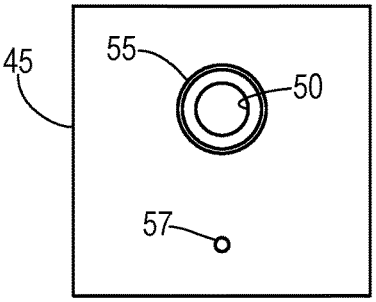
FIG. 5 is a plan view of a seating wall according to one embodiment of the valve of the invention.
Figure 6:
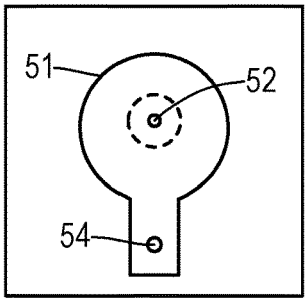
FIG. 6 is a plan view showing a flat spring member mounted to the seating wall of FIG. 5.

FIG. 5 shows a plan view of sealing wall 45 with aperture opening 50 surrounded by raised sealing rib 55. A mounting hole 57 is provided for attaching a flat sheet-metal spring for forming movable flap 51 has shown in FIG. 6 using fastening pin 54 so that orifice 52 in flap 51 is aligned with opening 50.

Figure 7:
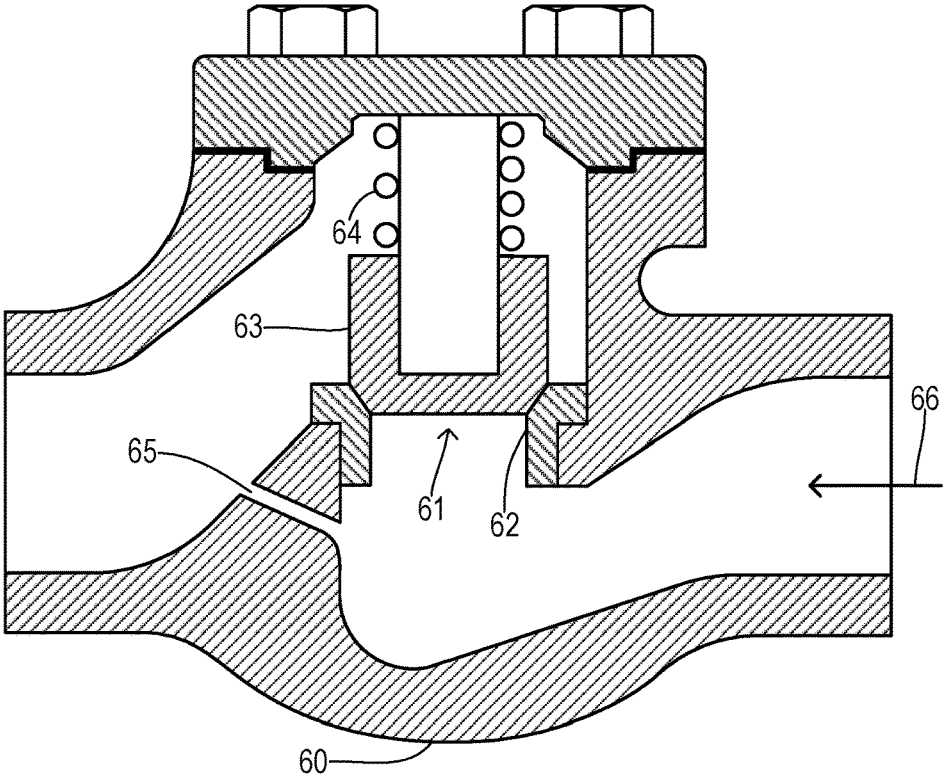
FIG. 7 is a cross-sectional view of a modified check valve used in alternative embodiment of the invention.

A valve using a movable flap is particularly adapted for use in an oil separator. The dual-acting valve may also be located in other structures of the PCV system, such as being integrated with a vent line connector or inserted as a separate device in a vent line. Various types of check valves may be employed such as the valve shown in FIG. 7 wherein a valve body 60 includes an opening 61 with a valve seat 62 for receiving a plunger 63 which is normally disposed against seat 62 by a spring 64. A bypass passage 65 bypasses the valve seat for providing the first flow capacity into the crankcase. During reverse flow indicated by arrow 66, plunger 63 is lifted off from valve seat 62 to provide a second flow capacity out from the crankcase which is greater than the first flow capacity. Valve body 60 is adaptable for use as a separate device connected in a PCV line or as an integral device formed with a connector, for example.

Figure 8:
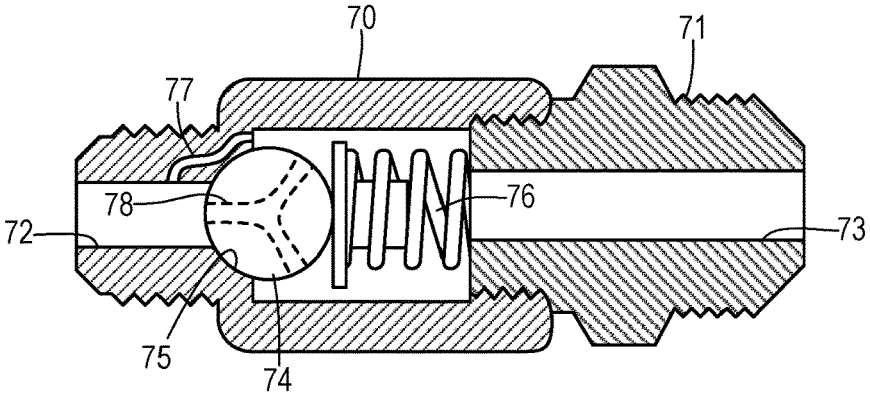
FIG. 8 is a cross-sectional view of another modified check valve used in another alternative embodiment of the invention.

FIG. 8 shows another embodiment wherein a valve body is comprised of a housing 70 and a threaded plug 71 with internal passages 72 and 73, respectively. A check ball 74 lodged in passage 72 is normally disposed against a valve seat 75 by a spring 76. A bypass passage 77 in housing 70 may be configured to provide a first flow capacity into the crankcase. Alternatively, check ball 74 may include bypass passages 78. Check ball 74 is movable to the right against spring 76 in order to allow a reverse flow from the crankcase into passage 72 and out from passage 73, thereby providing a second flow capacity for venting blowby gas which is greater than the first flow capacity.

What is claimed is:

1. A vehicle comprising: an internal combustion engine with an intake manifold receiving fresh air via an inlet duct, wherein the engine includes a crankcase; a turbocharger having a compressor with an inlet coupled to the inlet duct and an outlet coupled to the intake manifold; a first vent line coupling the crankcase with the compressor inlet; and a second vent line coupling the crankcase with the compressor outlet and intake manifold, the second vent line having a valve blocking air flow into the crankcase and allowing air flow out from the crankcase; wherein the first vent line comprises a dual-acting check valve controlled by flow direction in the first vent line and having a first flow capacity into the crankcase and a second flow capacity out from the crankcase which is greater than the first flow capacity, wherein the dual-acting check valve comprises a movable element and a valve body with a valve seat which opens to permit air flow out from the crankcase with the second flow capacity, and wherein the dual-acting check valve comprises a bypass passage which is always open and is configured to provide the first flow capacity.

2. The vehicle of claim 1 wherein the valve of the second vent line is comprised of a check valve.

3. The vehicle of claim 1 wherein the bypass passage is formed in the valve body.

4. The vehicle of claim 1 wherein the bypass passage is formed in the movable element.

5. A ventilation system for a crankcase of a turbocharged combustion engine, comprising: a vent line coupling the crankcase to a low pressure side of a turbocharger; and a check valve in the vent line comprising a movable element, a valve body with a valve seat and an always open bypass passage formed in one of the valve body or the movable element having a first capacity into the crankcase supplying air during engine idling, wherein the movable element opens from the valve seat with a unidirectional second capacity greater than the first capacity out from the crankcase to vent engine blowby during operation of the turbocharger.

* * * * *